US007959410B2

(12) United States Patent
Aubin et al.

(10) Patent No.: US 7,959,410 B2
(45) Date of Patent: Jun. 14, 2011

(54) ASSEMBLY FOR AN AIRCRAFT ENGINE COMPRESSOR COMPRISING BLADES WITH HAMMER ATTACHMENT WITH INCLINED ROOT

(75) Inventors: Stephan Yves Aubin, Charenton le Pont (FR); Stephan Julliot, Bussy Saint Georges (FR)

(73) Assignee: SNECMA, Paris (FR)

( * ) Notice: Subject to any disclaimer, the term of this patent is extended or adjusted under 35 U.S.C. 154(b) by 951 days.

(21) Appl. No.: 11/742,834

(22) Filed: May 1, 2007

(65) Prior Publication Data

US 2008/0170942 A1 Jul. 17, 2008

(30) Foreign Application Priority Data

May 12, 2006 (FR) ..... 06 51712

(51) Int. Cl.
*F04D 29/34* (2006.01)
*F01D 5/30* (2006.01)

(52) U.S. Cl. ..... 416/215; 416/219 R; 416/248

(58) Field of Classification Search ..... 416/219 R, 416/215, 214 A, 248, 239, 220 R
See application file for complete search history.

(56) References Cited

U.S. PATENT DOCUMENTS

| | | | | |
|---|---|---|---|---|
| 1,156,529 | A * | 10/1915 | Hillner | 416/215 |
| 4,684,325 | A * | 8/1987 | Arnold | 416/215 |
| 2005/0129521 | A1* | 6/2005 | Naudet | 416/215 |

FOREIGN PATENT DOCUMENTS

| | | | |
|---|---|---|---|
| DE | 41 08 930 | A1 | 10/1991 |
| EP | 1 219 782 | A2 | 7/2002 |
| GB | 778 667 | | 7/1957 |
| GB | 2 271 817 | A | 4/1994 |
| JP | 57-186004 | | 11/1982 |
| WO | WO 97/49921 | | 12/1997 |

* cited by examiner

*Primary Examiner* — Edward Look
*Assistant Examiner* — Dwayne J White
(74) *Attorney, Agent, or Firm* — Oblon, Spivak, McClelland, Maier & Neustadt, L.L.P.

(57) ABSTRACT

A disk/blade assembly for an aircraft engine compressor is disclosed. The assembly includes a disk and a plurality of blades with hammer attachment. Each blade includes a blade root provided with an upstream bearing surface situated on a leading edge side of the airfoil and a downstream bearing surface situated on a trailing edge side of this airfoil. The disk is provided with a circumferential groove in which the blade root of each of the blades is held by the bearing surfaces. For each of the blades, the downstream bearing surface is offset circumferentially from the upstream bearing surface in a given direction of offset, corresponding to the direction of offset between the trailing edge and the leading edge of the airfoil.

8 Claims, 4 Drawing Sheets

ASSEMBLY FOR AN AIRCRAFT ENGINE COMPRESSOR COMPRISING BLADES WITH HAMMER ATTACHMENT WITH INCLINED ROOT

BACKGROUND OF THE INVENTION

The present invention relates in general to a disk/blade assembly for an aircraft engine compressor, comprising a disk and a plurality of blades with hammer attachment mounted on this same disk, and more precisely in a circumferential groove of the latter.

Preferably, the application relates to the high-pressure compressor of an aircraft engine such as a turbojet or a turboprop, and preferably the rear stages of this compressor. However, the invention could equally apply to the low-pressure compressor, without departing from the context of the invention.

The invention also relates to a high-pressure or low-pressure aircraft engine compressor fitted with at least such a disk/blade assembly, and an aircraft engine furnished with at least one such compressor.

DESCRIPTION OF THE PRIOR ART

The prior art effectively divulges a disk/blade assembly for an aircraft engine compressor comprising a disk and a plurality of blades with hammer attachment mounted on this disk, in which each blade comprises successively, in an inward radial direction, an airfoil, a platform, a stilt, and a blade root provided with an upstream bearing surface situated on a leading edge side of the airfoil and a downstream bearing surface situated on a trailing edge side of this airfoil.

In addition, the disk is provided with a circumferential groove in which the blade root of each of the blades is held by means of bearing surfaces resting against this circumferential groove provided for this purpose. This therefore makes it possible to hold the blades in the radial direction toward the outside, relative to the disk in which their blade root is housed.

It has been noted in the embodiments of the prior art that the intensity of the mechanical stresses encountered at the bearing surfaces and the stilt were extremely uneven, very evidently implying problems of design.

SUMMARY OF THE INVENTION

The object of the invention is therefore to propose a disk/blade assembly with hammer attachment remedying the problem mentioned above relative to the embodiments of the prior art.

To do this, the subject of the invention is a disk/blade assembly for an aircraft engine compressor, comprising a disk and a plurality of blades with hammer attachment mounted on this disk, each blade comprising successively, in an inward radial direction, an airfoil comprising a leading edge and a trailing edge offset circumferentially from the leading edge in a given direction of offset, a platform, a stilt, and a blade root provided with an upstream bearing surface situated on a leading edge side of the airfoil and a downstream bearing surface situated on a trailing edge side of this airfoil, the disk being provided with a circumferential groove in which the blade root of each of the plurality of blades is held by means of the bearing surfaces resting against this circumferential groove. According to the invention, for each of the plurality of blades, the downstream bearing surface is offset circumferentially from the upstream bearing surface in the aforementioned given direction of offset.

Consequently, the invention advantageously proposes to change the geometry of the blade roots used hitherto that consisted in extending each root parallel to a central axis of the disk, going from its upstream bearing surface to its downstream bearing surface. Specifically, in the proposed configuration in which the downstream bearing surface is offset circumferentially from the upstream bearing surface in the given direction of offset corresponding to the direction of offset of the trailing edge of the airfoil relative to the leading edge of the latter, the advantageous consequence lies in the fact that the blade root and its associated stilt substantially follow the profile of the airfoil. In other words, when looking at a given blade from above, the magnitude of the intersection between the blade root and the airfoil is therefore greatly increased relative to that encountered in the prior art, where this magnitude remained relatively small due to the little compatibility between the orientation of the root along the central axis of the disk, and the geometry of the profiled airfoil.

This then makes it possible to obtain a better evenness in the intensity of the mechanical stresses encountered at the bearing surfaces and the stilt, which therefore advantageously considerably reduces the design difficulties encountered heretofore.

In addition, this specific feature also makes it possible to envisage an increase in the extent of the bearing surfaces in the circumferential direction, and therefore to offer a better retention of the blades and a reduction in the peening pressures.

It is noted that the assembly according to the invention is preferably designed so that the upstream and downstream bearing surfaces of one and the same blade "overlap" one another partially in the circumferential direction, in a view taken along the central axis of the associated disk.

Preferably, each of the plurality of blades is designed so that, in a view taken from above relative to this blade, a main direction in which the blade root extends, from its upstream bearing surface to its downstream bearing surface, is offset from a central axis of the disk by an angle A lying between 0.5 and 10°, such as for example approximately 3°. This then makes it possible to obtain simultaneously a satisfactory evenness of the intensity of the mechanical stresses encountered at the bearing surfaces and the stilt, and a satisfactory evenness of the intensity of the peening pressures encountered.

Preferably, for each of the plurality of blades, the blade root has two opposite circumferential end surfaces, arranged on either side of the bearing surfaces, these circumferential end surfaces each having a substantially flat shape. As an alternative, they may have a substantially concave shape, which makes it possible to envisage a substantial increase in their extent and hence to improve the retention of the blade and the distribution of the peening pressures, without, for all that, significantly penalizing the overall weight of this blade. Effectively, with the latter geometry, the blade root, and where necessary the associated stilt, has a wasp-waist shape implying that its central portion has a length in the circumferential direction that is less than that of the two axial end portions placed on either side of the aforementioned central portion, in the axial direction of the disk, and incorporating respectively the upstream bearing surface and the downstream bearing surface.

Finally, provision can be made for each of the plurality of blades to be designed so that in a view taken from above relative to this blade, a baric center of the upstream and downstream bearing surfaces of the blade root, considered in this view, forms a central center of symmetry for the upstream and downstream bearing surfaces.

A further subject of the invention is an aircraft engine compressor fitted with at least one such disk/blade assembly, preferably provided to form at least partially a rear stage of this compressor, and in particular of a high-pressure compressor.

Finally, a further subject of the invention is an aircraft engine, such as a turbojet, comprising at least one such compressor.

Other advantages and features of the invention will appear in the nonlimiting detailed description below.

BRIEF DESCRIPTION OF THE DRAWINGS

This description will be made with respect to the appended drawings amongst which.

DETAILED DESCRIPTION OF THE PREFERRED EMBODIMENTS

Figure 1:
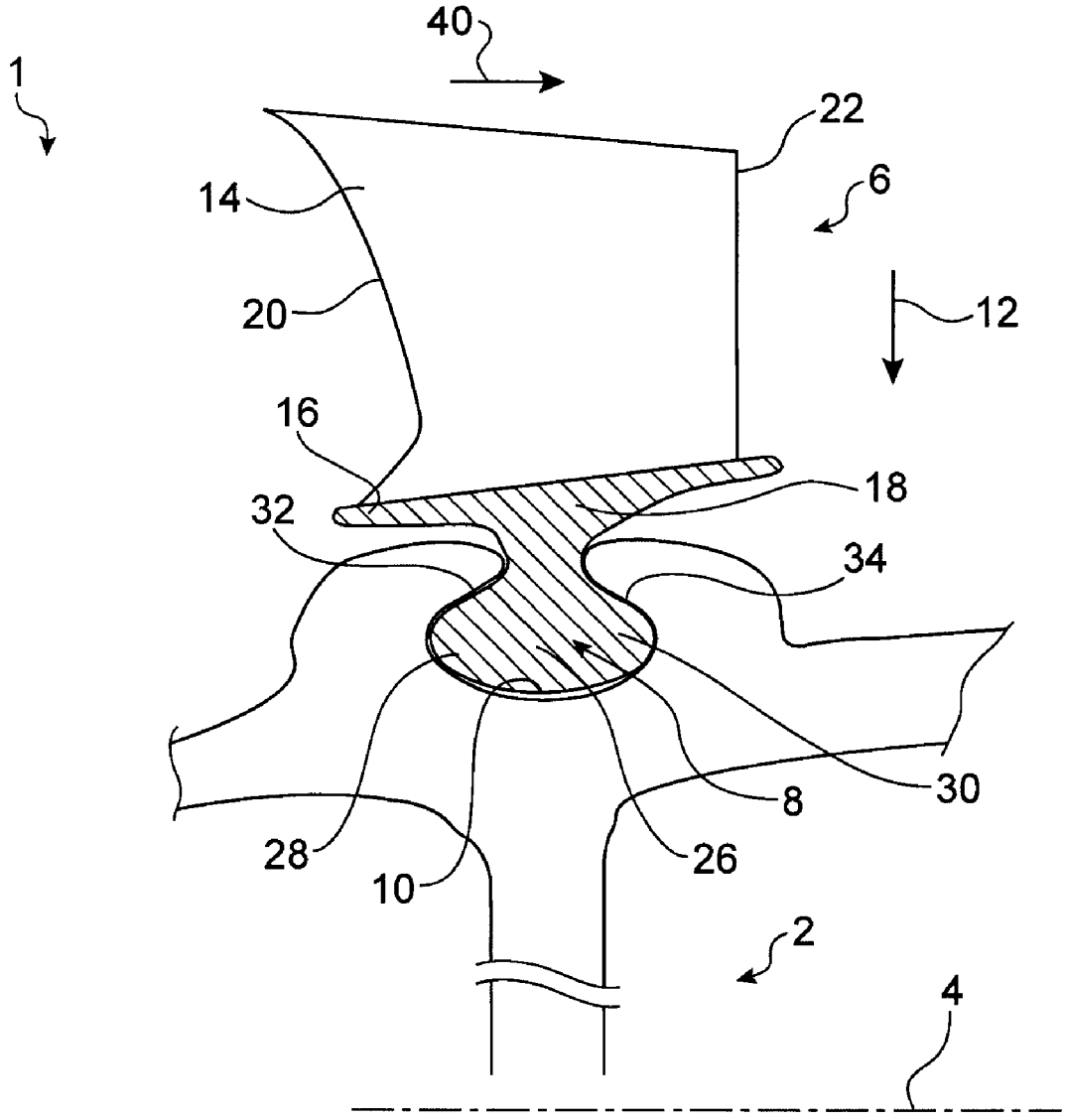
FIG. 1 represents a view in section of a disk/blade assembly with hammer attachment for an aircraft engine compressor, according to a preferred embodiment of the present invention.

With reference first of all to FIG. 1, a disk/blade assembly 1 for a high-pressure compressor of an aircraft engine such as a turbojet can be seen, this assembly 1, preferably designed to form a part of one of the rear stages of this high-pressure compressor, being in the form of a preferred embodiment of the present invention.

In a manner known to those skilled in the art, this assembly first of all comprises a disk 2 having a central axis 4 corresponding to the longitudinal axis of the turbojet. At a circumferential radial end of this disk 2, the latter supports a plurality of blades 6 called blades with hammer attachment, that are therefore distributed angularly all about the central axis 4. These blades 6 with hammer attachment have the specific feature of including a blade root 8 designed to be housed in a circumferential groove 10 of the disk 2, this circumferential groove of the disk therefore being situated at a radial end of the disk 2 and being radially open outward. As is known to those skilled in the art, this circumferential groove 10 has an enlarged notch making it possible to insert the root of each blade into the groove, these blades then being moved circumferentially inside the groove 10. In addition, once all of the blades have been inserted and put in place inside the circumferential groove 10, small hammers (not shown) may then be inserted to provide the overall retention of the assembly. As is clearly visible in FIG. 1, the circumferential groove 10 generally has the shape of a C opening radially outward, and making it possible, between the two ends of this C, to allow the stilt of the blade to pass as will now be described.

Specifically, each blade 6 comprises, in a manner known to those skilled in the art, successively in an inward radial direction shown by the arrow 12, an airfoil 14, a platform 16, a stilt 18 and, finally, the aforementioned blade root 8. Accordingly, it is noted that the airfoil conventionally has a leading edge 20 and a trailing edge 22, the trailing edge 22 being offset in the circumferential direction of the disk relative to the leading edge 20 in a given direction of offset, a function of the profile of this airfoil. Then, the platform has a circumferential length much greater than that of the airfoil 14 that it supports, and is preferably designed to come as close as possible to the platform of the two blades 6 of the assembly that are directly adjacent thereto. Therefore, when all the blades are mounted inside the groove 10, the platforms 16 of these blades substantially form a circular ring centered on the axis 4.

The stilt 18 has much smaller dimensions than those of the platform oriented radially outward relative to the latter, both in the axial direction and the circumferential direction of the disk. As has been mentioned before, this stilt 18 supports radially inward the blade root 8 serving to retain the blade relative to the disk 2 on which it is mounted.

Figure 2:
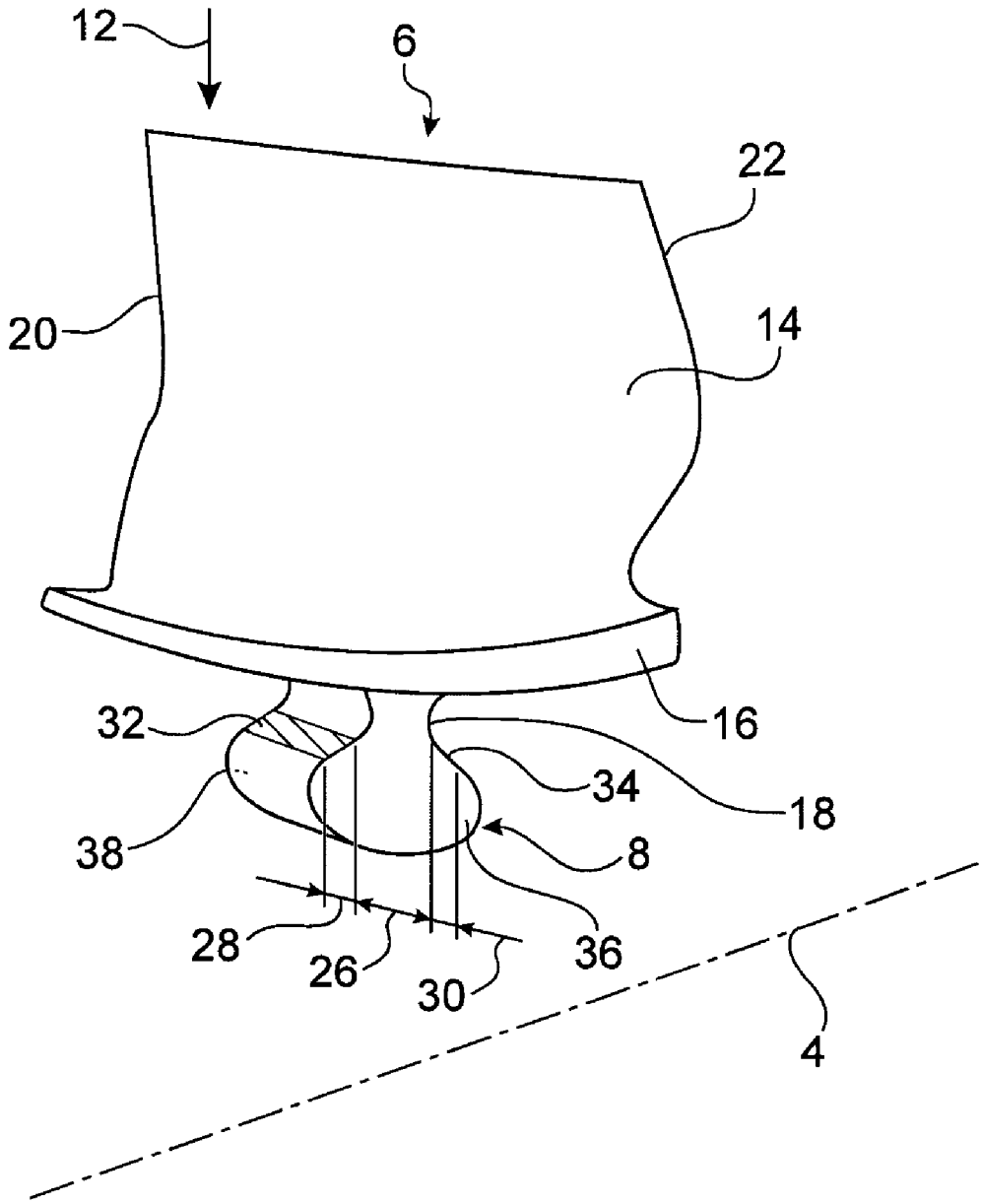
FIG. 2 represents a view in perspective of one of the blades with hammer attachment forming an integral part of the assembly shown in FIG. 1.

As can be seen in FIGS. 1 and 2, the blade root 8 can be defined as having three successive portions in the axial direction of the given disk by its central axis 4, it being however noted that the whole of the blade root 8, and preferably the whole of the blade 6, may be made in a single piece, by any technique known to those skilled in the art. Thus, the blade root has in effect a central portion 26 located globally in the internal radial extension of the stilt 18. Upstream of this central portion 26, there is an upstream axial end portion with reference number 28 and having an upstream bearing surface 32 generally oriented radially outward. In a similar manner, downstream of this central portion 26, there is a downstream axial end portion with reference number 30 and having a downstream bearing surface 34, also generally oriented radially outward.

In this respect, it is specified that the terms upstream and downstream used in the description are given relative to a main direction of flow of the fluid through the assembly 1, this direction being represented schematically by the arrow 40, and therefore being parallel to the axial direction of this assembly and to its central axis 4.

Finally, it is noted that the blade root 8 has two opposite circumferential end surfaces, with reference numbers 36, 38 respectively in FIG. 2, these surfaces preferably being situated in the continuity of the opposite circumferential end surfaces of the stilt 18, as is more clearly visible in FIG. 2. Accordingly, it is specified that these two surfaces 36, 38 may be substantially flat, as will be described with reference to FIG. 3, and parallel to the aforementioned radial direction 12.

As is most visible in FIG. 1, it can be seen that the radial outward retention of the blade 6 relative to the disk 2 is provided by the contact of the two bearing surfaces 32, 34 oriented substantially radially outward, with the two branches of the C formed by the circumferential groove 10. In this respect, it is specified that the upstream and downstream contacts sought with the bearing surfaces 32, 34 are preferably flat contacts.

Figure 3:
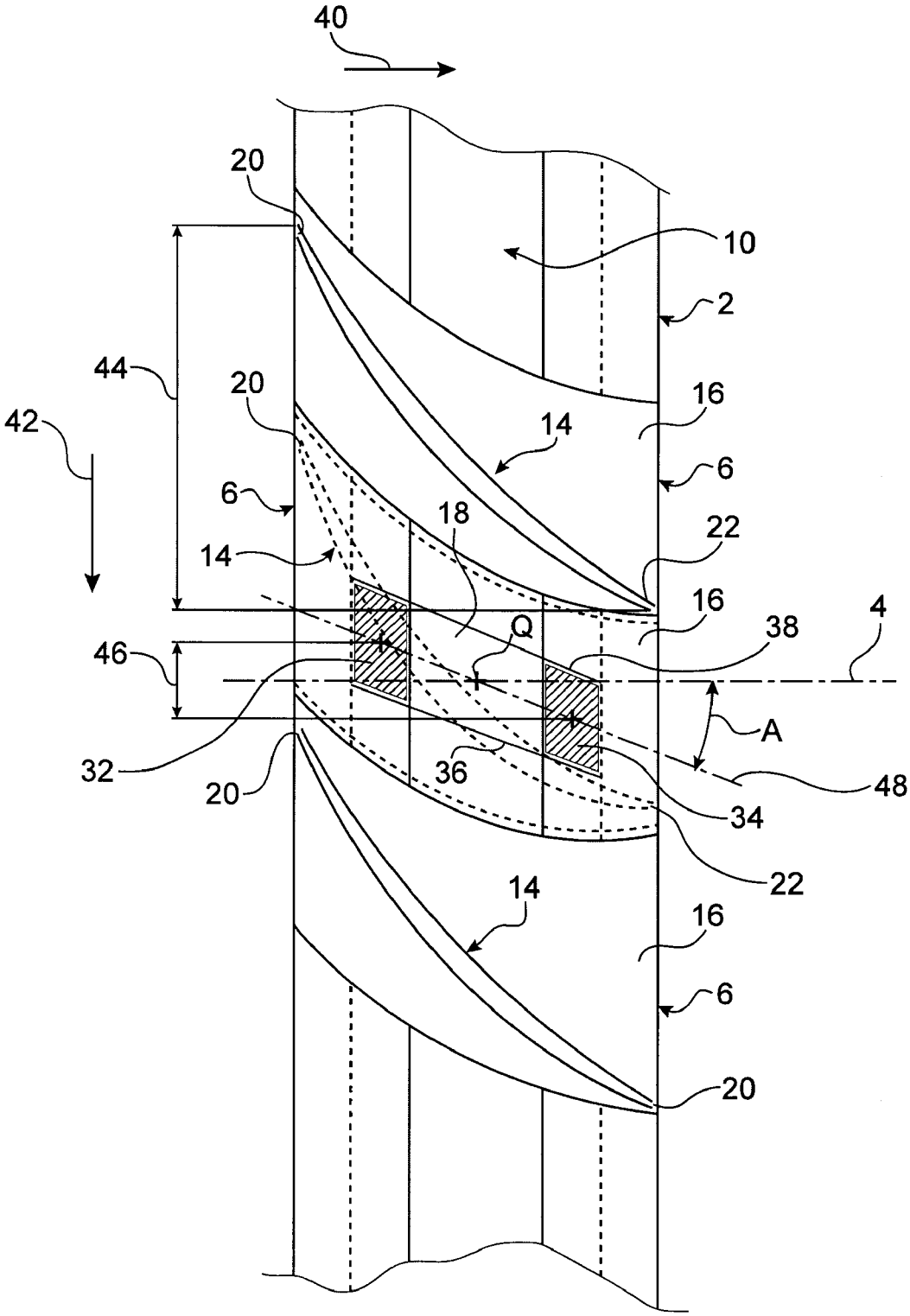
FIG. 3 represents a partial view of the disk/blade assembly shown in FIG. 1, taken from above relative to a given blade of this assembly.

Now with reference to FIG. 3, one of the particular features of the present invention can be seen, according to which the upstream bearing surface 32 is offset from the downstream bearing surface 34, in the circumferential direction. More precisely, it can be seen that the trailing edge 22 of the airfoil 14 is offset in the circumferential direction of the disk 2 relative to the trailing edge 20 in a given circumferential direction of offset, referenced schematically by the arrow 42 in this FIG. 3. In this same figure, corresponding to a view from above taken relative to the central blade represented partially in dashed lines for reasons of clarity and situated between the two blades 6 also represented in this same figure, the circumferential offset between the leading edge 20 and the trailing edge 22 of one of these two blades situated on either side of the central blade 6 has been represented schematically by the dimension with reference number 44. As such, it is specifically in this same given circumferential direction of offset 42 that the downstream bearing surface 34 is offset relative to the upstream bearing surface 32, the offset here being represented schematically by the dimension with reference number 46.

As is clearly visible in this FIG. 3, the circumferential offset of the two bearing surfaces 32, 34 is much smaller than that encountered between the leading edge 20 and the trailing edge 22 of the associated airfoil 14. This is especially explained by the fact that the aim is to obtain a geometry 16 by which a main direction 48 of the blade root is offset from the central axis 4 by an angle A lying between 0.5 and 10 degrees, such as for example 3 degrees. It is specified that "the main direction of the blade root" means the direction in which this blade root extends from its upstream bearing surface to its downstream bearing surface, this direction in particular being able to be represented by a straight line passing through the baric center of each of the two aforementioned bearing surfaces, considered in a view from above as shown in FIG. 3.

In this preferred embodiment of the present invention, provision is effectively made for the opposite circumferential end surfaces 36, 38 each to have a substantially flat shape, namely parallel with both the radial direction of the blade and the abovementioned main direction 48.

Figure 4:
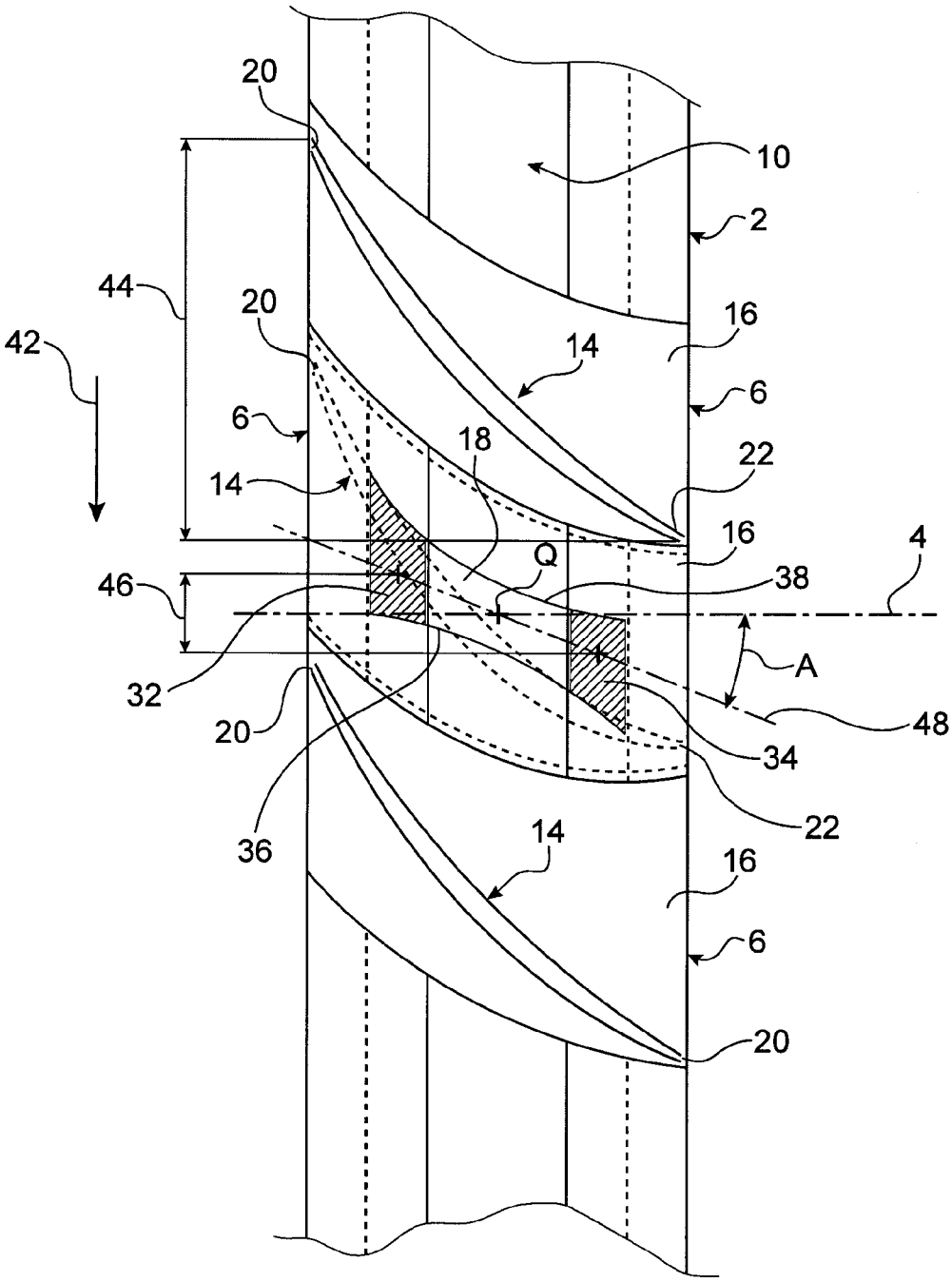
FIG. 4 represents a partial view of a disk/blade assembly according to another preferred embodiment of the present invention, taken from above relative to a given blade of this assembly.

As shown in FIG. 4, it is possible to provide, in another preferred embodiment of the present invention, for each of these two circumferential end surfaces 36, 38 to have a concave shape, thereby allowing the stilt and the blade root to have a generally wasp-waist shape, in particular allowing an enlargement in the circumferential direction of the bearing surfaces 32, 34. In this preferred embodiment, provision is made for these concave-shaped surfaces to remain substantially parallel to the radial direction of the blade. In addition, they are situated in the extension of the circumferential end surfaces of the stilt 18 having the same concavity.

Irrespective of the preferred embodiment envisaged, provision is made to ensure that, in a top view taken relative to any one of the blades 6, the baric center referenced Q in FIG. 4, corresponding to the baric center of the upstream and downstream bearing surfaces 32, 34 combined, considered in this same top view, forms a central center of symmetry for these two bearing surfaces 32, 34 associated with the same blade 6.

Naturally, various modifications may be made by those skilled in the art to the invention that has just been described by way of a nonlimiting example only.

The invention claimed is:

1. A disk/blade assembly for an aircraft engine compressor comprising:

a disk; and a plurality of blades with hammer attachment mounted on said disk, each blade comprising successively, in an inward radial direction, an airfoil including a leading edge and a trailing edge offset circumferentially from said leading edge in a given direction of offset, a platform, a stilt, and a blade root provided with an upstream bearing surface situated on a leading edge side of the airfoil and a downstream bearing surface situated on a trailing edge side of this airfoil, wherein the disk is provided with a circumferential groove in which said blade root of each of said plurality of blades is held by said bearing surfaces resting against the circumferential groove, wherein, for each blade of said plurality of blades, the downstream bearing surface is offset circumferentially from the upstream bearing surface in said given direction of offset, wherein, for each blade of said plurality of blades, the blade root includes two opposite circumferential end surfaces arranged on either side of said bearing surfaces, the circumferential end surfaces each includes a substantially concave shape.

2. The disk/blade assembly for a compressor as claimed in claim 1, wherein each blade of said plurality of blades is designed so that, in a view taken from above relative to said blade, a main direction in which said blade root extends, from its upstream bearing surface to its downstream bearing surface, is offset from a central axis of said disk by an angle A lying between 0.5 and 10°.

3. The disk/blade assembly for a compressor as claimed in claim 2, wherein said angle A is approximately 3°.

4. The disk/blade assembly for a compressor as claimed in claim 1, wherein each of said plurality of blades is designed so that, in a view taken from above relative to said blade, a baric center of said upstream and downstream bearing surfaces of the blade root, considered in this view, forms a central center of symmetry for said upstream and downstream bearing surfaces.

5. An aircraft engine compressor, fitted with at least one disk/blade assembly as claimed in claim 1.

6. An aircraft engine comprising at least one compressor as claimed in claim 5.

7. The disk/blade assembly for a compressor as claimed in claim 1, wherein the circumferential groove has a shape of a C opening radially outward.

8. The disk/blade assembly for a compressor as claimed in claim 1, wherein the platform of each blade of the plurality of blades is curved in the circumferential direction.

* * * * *